US007624614B2

(12) United States Patent
Heid et al.

(10) Patent No.: US 7,624,614 B2
(45) Date of Patent: Dec. 1, 2009

(54) CONVEYOR FOR TRANSPORTING WORK PIECES IN A PRESS

(75) Inventors: Rudolf Heid, Luterbach (CH); Hans-Ulrich Kurt, Kriegstetten (CH); Ulrich Lehmann, Langenthal (CH)

(73) Assignee: Gudel Group AG, Langenthal (CH)

( * ) Notice: Subject to any disclaimer, the term of this patent is extended or adjusted under 35 U.S.C. 154(b) by 280 days.

(21) Appl. No.: 10/580,205

(22) PCT Filed: Nov. 25, 2004

(86) PCT No.: PCT/CH2004/000710

§ 371 (c)(1),
(2), (4) Date: Feb. 22, 2007

(87) PCT Pub. No.: WO2005/051563

PCT Pub. Date: Jun. 9, 2005

(65) Prior Publication Data

US 2007/0137505 A1 Jun. 21, 2007

(30) Foreign Application Priority Data

Nov. 25, 2003 (CH) ..... PCT/CH03/00780

(51) Int. Cl.
*B21J 11/00* (2006.01)

(52) U.S. Cl. ..... 72/405.16; 72/405.13

(58) Field of Classification Search ..... 72/405.09, 72/405.11–405.13, 405.16; 198/468.1, 468.4; 294/87.1

See application file for complete search history.

(56) References Cited

U.S. PATENT DOCUMENTS

| | | | | |
|---|---|---|---|---|
| 5,979,212 | A * | 11/1999 | VanderZee et al. | 72/405.09 |
| 6,082,162 | A * | 7/2000 | Muschalik et al. | 72/253.1 |
| 6,371,544 | B1 * | 4/2002 | Wang | 294/87.1 |
| 2003/0084701 | A1 * | 5/2003 | Kawamoto | 72/405.1 |

FOREIGN PATENT DOCUMENTS

| | | | |
|---|---|---|---|
| DE | 31 14 476 | A | 1/1983 |
| DE | 4101513 | A1 * | 8/1991 |

(Continued)

*Primary Examiner*—Dana Ross
*Assistant Examiner*—Stephanie Jennings
(74) *Attorney, Agent, or Firm*—Birch, Stewart, Kolasch & Birch, LLP

(57) ABSTRACT

A conveyor for transporting work pieces in a press, in particular a press line or multiple-die press, from a first station to a second station adjacent to the first station, comprises at least one lateral beam (300, 400) arranged on a side of the press, essentially extending parallel to a transport direction of the conveyor (52), at least one bar (500) having grippers (502) for gripping the work piece to be transported, whereby the bar (500) is attached to the lateral beam (300, 400) in such a way that it is movable along a longitudinal extension of the beam (300, 400); and for each lateral beam (300, 400) an assembly (100, 200) for supporting the lateral beam (300, 400). The assembly (100, 200) comprises a pivoting mechanism (106, 107, 108, 109, 301, 302) for pivoting the lateral beam (300, 400) around a horizontal pivotal axis perpendicular to the transport direction, and the grippers (502) are rotatably movable for at least compensating a change of orientation of the work piece due to the pivoting of the lateral beam (300, 400).

16 Claims, 8 Drawing Sheets

FOREIGN PATENT DOCUMENTS

| | | | |
|---|---|---|---|
| DE | 100 10 079 | A1 | 9/2000 |
| EP | 0 309 430 | A | 3/1989 |
| EP | 0 600 254 | A | 6/1994 |
| EP | 0 621 093 | B1 | 10/1994 |
| EP | 0 850 709 | B1 | 7/1998 |

* cited by examiner

CONVEYOR FOR TRANSPORTING WORK PIECES IN A PRESS

BACKGROUND OF THE INVENTION

1. Field of the Invention

The invention relates to a conveyor for transporting work pieces in a press, in particular a press line or multiple-die press, from a first station to a second station adjacent to the first station, comprising at least one lateral beam arranged on a side of the press, essentially extending parallel to a transport direction of the conveyor, at least one bar having grippers for gripping the work piece to be transported, whereby the bar is attached to the lateral beam in such a way that it is movable along a longitudinal extension of the beam, and for each lateral beam an assembly for supporting the lateral beam.

2. Description of the Related Art

An important step of the manufacture of components made of sheet metal is the forming step. Sheet metal parts are formed in a press, such as a hydraulic, hydroforming, mechanical, electrical or pneumatic press, typically including an upper die and a corresponding lower die. The dies are moved against each other, and thereby the work piece arranged in the work space between the dies is formed. The form of the dies determines the impact on the work piece and therefore the resulting form. Usually, a succession of forming steps using differently shaped dies is necessary until the desired form of the sheet metal part is obtained. To achieve this in an expedient way, a plurality of presses is arranged successively to form a press line, or a press is employed that includes multiple dies. On one hand, the capacity of the press line or multiple-die press is determined by the capacity of the press, i.e. the time required for carrying out one forming operation. On the other hand however, the capacity is significantly depending on the efficiency of the transport of the work pieces from one press station to the next one. It is therefore important to employ a fast transfer system for automatically transporting work pieces from one press station to the next one.

The German patent application DE 100 10 079 A1 (Müller-Weingarten) refers to a conveyor attached to a vertical support of a press. The conveyor comprises a vertical drive having two cogwheels independently acting on two vertical cograils. Both the cograils act on a third cogwheel arranged in between them, to which a pivotable arm is directly connected. By combining the vertical as well as the pivoting motion of the arm a work piece may be transported from a press station to the next one.

The European patent EP 0 850 709 B1 (Schuler) discloses a conveyor where a cross bar is attached on both its sides to guide-rod mechanisms. The rods of the mechanism are independently attached to vertically movable slides mounted to a vertical press support. By displacing the slides the cross bar is movable in a vertical as well as in a horizontal direction.

These conveyors only allow for a limited transport range that directly depends on the length of the pivotable arm or the guide rods, respectively.

The European patents EP 0 621 093 B1 (Müller-Weingarten) and EP 0 600 254 B1 (Schuler) as well as the US patent application US 2003/84701 A1 (Komatsu) refer to conveyors for a press line, where cross bars having grippers for gripping the work pieces extend between transport carriages arranged at both sides of the press. The transport carriages are independently movable on horizontal supporting rails extending parallel to the transport direction of the conveyor. Where the carriages of EP 0 621 093 B1 comprise a vertical drive for lifting and lowering the cross bar, the EP 0 600 254 B1 and US 2003/84701 A1 disclose supporting rails that are vertically movable.

In principle these conveyors allow for a transport range that is only limited by the length of the supporting rails. However, the construction of the conveyors is rather complex and the mass of the components that have to be moved in a horizontal and/or vertical direction during the transport process is large. Correspondingly, the achievable speed and efficiency is limited.

SUMMARY OF THE INVENTION

It is the object of the invention to create a conveyor pertaining to the technical field initially mentioned, that is of a simple construction, allows for a long transport range and for efficient and fast transport of the work pieces.

The solution of the invention is specified by the features of the claimed invention. According to the invention, the assembly for supporting the lateral beam comprises a pivoting mechanism for pivoting the lateral beam around a horizontal pivotal axis perpendicular to the transport direction and the grippers are rotatably movable for at least compensating a change of orientation of the work piece due to the pivoting of the lateral beam.

Substantially, the vertical displacement of the bar attached to the lateral beam is achieved by the pivoting motion of the entire lateral beam. This motion allows for rapidly lowering and lifting the bar, the lateral beam acting as a lever. The mass of the components to be moved during the transport process is reduced. Neither it is necessary to vertically displace the entire beam nor to employ a rather heavy carriage comprising a vertical drive for lifting or lowering the bar, where this heavy carriage has to be moved along the beam. In principle, the transport range of the inventive conveyor is not limited; it is generally determined by the length of the lateral beam. Still, the construction of the conveyor according to the invention is simple and therefore the conveyor may be produced inexpensively.

Despite the pivoting motion, the lateral beam always essentially extends parallel to the transport direction of the conveyor. Depending on the transport distance and the required lift range, the pivoting angle relative to a horizontal plane is at most 3-15°. This is sufficient for gripping a work piece, lifting it and transporting it out of the first station. The horizontal movement of the work piece is substantially achieved by the movement of the bar along the lateral beam.

The stations between which the work pieces are transported may be press stations comprising two cooperating dies as well as other stations of a transfer press such as an initial feed station, an intermediate deposit station arranged in between press stations or a final delivery stack or a conveyor, carrying away the formed work pieces. The conveyor may e.g. be constituted by a usual conveyor belt, by a robot stacking the formed work pieces or by a shuttle transporting the work pieces to an unloading station.

The grippers may be freely chosen from existing solutions, depending on the work pieces to be transported. The grippers may grip the work pieces in particular by suction, magnetic forces, form fit or traction as do suction tools, magnetic tools or tools that engage with recesses, openings or protrusions of the work pieces.

Generally, the bar for gripping the work pieces extends horizontally and perpendicular to the transport direction. However, any direction of the bar is possible, which allows for gripping and disengaging the work pieces in the stations of the press.

The rotary motion of the grippers is preferentially achieved by rotating the bar around its longitudinal axis. In the usual case of a horizontal bar, extending perpendicular to the transport direction, the longitudinal axis of the bar is parallel to the pivotal axis of the lateral beam. Therefore, by rotating the bar around its longitudinal axis the grippers are rotated such that the change of orientation of the work piece resulting from the pivoting of the lateral beam may be exactly compensated. The rotary motion of the grippers is not limited to compensating the change of orientation however, but the orientation of the work piece may be changed as desired during the transport from a first to a second station, e.g. in order to adapt the orientation to the form and configuration of the lower die of the second station.

In general, the assembly supporting the lateral beam is arranged sideways of the press, preferably centrally in between the first and the second station. The assembly may be freestanding or attached to a neighboring station, in particular to a vertical support of a press, or attached to a bed of the press or of the press line.

Preferably, the pivoting mechanism is formed such that the pivotal axis crosses a vertical plane comprising the lateral beam either above, below or through the lateral beam, in particular close to a middle portion of the lateral beam. In this way, contrary to the situation where the plane is crossed sideways of the press, the lateral beam constitutes a rocker and during its motion along the beam the bar crosses the stationary point of its path, i.e. the point that does not move vertically if the lateral beam is pivoted. Therefore, the bar may be lifted and lowered at both the endpoints of its path, allowing for picking up or depositing the work piece near both ends of the lateral beam.

Furthermore, the arrangement allows for a simple construction having minimized torques and therefore minimized forces acting on components holding the lateral beam. This is especially true if the pivotal axis crosses the vertical plane close to the middle portion of the lateral beam, such that the mass compensation is optimized and the distribution of forces onto the components holding the lateral beam is most symmetric. Additionally, the end points of the beam perform a substantially vertical movement if the lateral beam is pivoted around a pivotal axis arranged close to the center of the lateral beam.

Advantageously, the conveyor comprises two lateral beams arranged across the press and the bar is a cross-bar extending across the press, attached to the two lateral beams. Using cross-bars held at both ends, torques acting on the lateral beam may be minimized, such that heavier loads may be transported using lighter components. However, the invention is not restricted to conveyors having cross bars but extends to conveyors with cantilever arms attached to the lateral beam, where the grippers for gripping the work piece are attached to these arms. In this case, lateral beams with attached cantilever arms may be arranged on both sides of the press or the conveyor is single-sided, i.e. all the cantilever arms for transporting the work pieces engage into the press from the same side.

Preferably, at least one of the assemblies for supporting one of the two lateral beams is supported such that is relocatable in a direction transverse to the transport direction, in order to adjust a distance between the two lateral beams. This allows for easily adapting the length of the cross bar to the width of the press, which in turn is depending on the size of the dies used. Either one of the assemblies is movable relative to the other, e.g. on rails, or both the assemblies holding the same cross-bar, arranged across the press are symmetrically movable. By employing a cross-bar of minimum length the mass of the moved parts and the forces acting on the lateral beams are minimized, allowing for greater flexibility and faster operation of the conveyor system.

Alternatively, the assemblies are mounted at fixed positions and the employed cross-bars are of a predetermined length allowing for transporting work pieces that have a maximum width processable by the press.

Preferentially, the assembly further comprises a lift mechanism for displacing the lateral beam in a vertical direction. This allows for lifting or lowering the lateral beam into a position where maintenance work may be carried out unhindered by the lateral beams, e.g. such that the dies of the press may be changed. Furthermore, the conveyor may be quickly adapted to differently formed presses and/or dies. Although the vertical movement of the gripper bar during operation of the press is substantially (preferably entirely) achieved by the pivoting motion of the lateral beam, the vertical displacement by the lift mechanism may be subsidiary employed during the transporting process if this allows for faster operation, e.g. in the case of exceptionally formed dies.

Alternatively, the conveyor may be formed such that the lateral beam is removable in another way for doing the maintenance work, e.g. by folding it away or by rotating the beam by about 90° into an upright position, such that the dies may be removed and inserted in between the beams.

Advantageously, the pivoting mechanism comprises two spindles coupled to the lateral beam, the spindles being independently operable in order to pivot and preferably vertically displace the lateral beam. By independently moving the spindles, in particular by counter-rotating the spindles, two spaced-apart support points of the lateral beam are displaced, allowing for pivoting the lateral beam. At least one of the couplings between the spindle and the lateral beam comprises a compensating mechanism for compensating a varying distance between the support points due to the independent operation of the spindles. Preferably, the two spindles are arranged parallel to each other and extend in a vertical direction. Accordingly, the support points are generally arranged side by side on the lateral beam. In this case, the lateral beam is vertically displaced if both the spindles are operated synchronously in the same sense of rotation such that both support points are concurrently lifted or lowered. In this preferred case, the compensating mechanism advantageously comprises a horizontal guidance for one of the couplings between the spindle and the lateral beam. Preferably, the spindles and couplings form ball screw assemblies.

A variety of alternative solutions exist for the pivoting mechanism. For example, the lateral beam may be mounted to a single horizontal pivot axle attached to the assembly, defining the pivotal axis of the beam. In this case, the pivoting motion may be controlled by a linearly driven guide rod (or a plurality of guide rods) rotatably attached to the lateral beam at any point distant from the pivotal axis. Another possibility is directly controlling the pivoting motion by a rotary drive coupled to the pivot axle.

Advantageously, the lateral beam comprises two couplings arranged along the longitudinal extension of the lateral beam, preferably symmetrically and close to a center of the lateral beam. Each of the couplings cooperates with one of the spindles. Arranging the couplings along the longitudinal extension of the lateral beam allows for directly coupling the spindles to the support points of the beams, where the lateral beam crosses the spindles; without the need for some kind of arm or similar intermediate piece. Thereby, the construction of the pivoting mechanism (especially of the couplings between the spindles and the support points of the lateral beam) is simplified and the space required (especially in a direction across the press) is reduced. The arrangement of the couplings close to the center of the lateral beam allows for rapidly pivoting the lateral beam by moderate displacements of one of the support points or both support points of the lateral beam. The symmetrics arrangement with respect to the center of the lateral beam provides for an optimum weight compensation of the two outer parts of the beam.

Alternatively, the spindles are coupled to terminal portions of the beam, e.g. by means of arms connecting the spindles to the support points of the beam.

Preferably, the lateral beam comprises a telescopic drive mechanism for the sliding movement of the bar. This allows for faster movement of the bar along the longitudinal extension of the beam without having to increase the relative acceleration between neighboring moved components. Therefore, the resulting acceleration of the bar may be increased, leading to improved performance of the conveyor. Furthermore, by employing a telescopic drive mechanism the range of the conveyor may be increased without having to lengthen the entire lateral beam. This avoids conflicts between neighboring beams and reduces the weight of the beam assembly.

Advantageously, the telescopic drive mechanism is constituted by a support beam attached to the pivoting mechanism, a first carriage slidably mounted to the support beam and a second carriage slidably mounted to the first carriage. This allows for a simple and light-weight construction of the lateral beam and at the same time for a stable guidance of the bar for gripping the work pieces.

Alternatively, other known telescopic drive mechanisms may be implemented to the lateral beam.

Preferably, especially in cases with long transport paths, an intermediate linear guideway is arranged between the support beam and the first carriage, whereby the guideway is slidable with respect to the support beam as well as with respect to the first carriage. Advantageously, the linear guideway is designed and arranged in such a way that its position with respect to the support beam and the first carriage is uniquely defined by the relative position of the first carriage with respect to the support beam. This may be achieved by providing for positive traction between the linear guideway and the support beam and the first carriage. Thereby, an additional drive for the additional stage of the telescopic drive mechanism is not required. By employing the linear guideway, the relative velocities of the linearly moving parts may be reduced, i.e. the relative velocity of the first carriage with respect to the support beam may be apportioned to a first velocity of the linear guideway with respect to the support beam and to a second velocity of the first carriage with respect to the linear guideway. Thereby, the mechanical stress effected by high velocities and accelerations may be alleviated. Furthermore, a linearly displaceable linear guideway allows for reliably supporting the first carriage on the support beam even in cases where the length of the support beam is reduced. By reducing the length and therefore the weight of the support beam, the forces and moments acting on the pivoting mechanism decrease. Furthermore, due to the smaller extension of the (linearly fixed) support beam, conflicts between the beam and the neighboring press stations may be avoided.

Preferentially, all the drives for moving the bar along the beam as well as for pivoting the beam are stationary in respect of the motion of the bar along the longitudinal extension of the beam. Thereby, the mass of the components that have to be rapidly moved is minimized. Furthermore, the power supply of stationary drives is much simpler than in the case of moving drives, requiring drag chains etc. In contrast to a state of the art conveyor having a carriage including a drive for vertically moving the bar, the drive for pivoting the longitudinal beam and thereby achieving the vertical displacement of the bar is arranged independently of the movement of the bar along the lateral beam. Most preferably, the drive is completely stationary as e.g. are two spindles attached to the assembly and coupled to the lateral beam. The drive for moving the bar along the beam is again stationary in respect of the motion of the bar along the beam. For instance, it may be attached to the central portion of the lateral beam and comprise a transmission such as a drive shaft, coupled to a carriage moved relative to the beam. Solely the small drive for rotary movement of the grippers has to be moved together with the bar and contributes to the mass of the rapidly moved components.

Alternatively, the drive for moving the bar along the beam may e.g. comprise a linear induction motor arranged between the longitudinal beam and a carriage holding the bar.

Different kinds of drives may be combined, e.g. a first stage of the telescopic drive mechanism may be actuated by a stationary electric motor by means of a rack-and-pinion gear, whereas further stages are actuated by linear motors.

A conveyor system for transporting work pieces in a press line or multiple die press comprises a plurality of conveyors, arranged consecutively. In general, with a press having a number N of stations, N+1 conveyors are required: N−1 conveyors in between the press stations, one conveyor for feeding the work pieces to the first press station and one conveyor for removing the work pieces from the last press station.

In the event flipping of the work piece is required from one station to the next one, as is often the case with double-action presses, two consecutive conveyors are preferably arranged such that the work piece may be handed over from a first of the conveyors to the second of the conveyors, whereby the work piece is flipped, i.e. rotated by about 180°. Thus, a dedicated intermediate station for flipping the work piece is not required.

A method for transporting work pieces in a press, in particular a press line or multiple-die press, from a first station to a second station adjacent to the first station, employing a bar attached to a lateral beam arranged on a side of the press, extending parallel to a transport direction, comprises the following steps:

a) positioning the bar above the work piece situated in the first station;
b) lowering the bar by pivoting the lateral beam around a horizontal pivotal axis perpendicular to the transport direction;
c) gripping the work piece by grippers attached to the bar;
d) lifting the bar by pivoting the lateral beam around the pivotal axis;
e) transporting the work piece to the second station by moving the bar along a longitudinal extension of the beam;
f) positioning the bar in a hand-over position by pivoting the lateral beam around the pivotal axis; and
g) disengaging the work piece from the grippers.

In particular, the hand-over position is reached by depositing the work piece in the second station, i.e. a press, an intermediate deposit station, a final delivery stack or a conveyor.

Some of the steps may be performed simultaneously, namely the lifting and/or lowering and transportation steps a) and b), d) and e) and/or e) and f), i.e. moving the bar along the longitudinal extension of the beam and pivoting, at least partially take place simultaneously. Thereby, the transporting process may be expedited. After the work piece has been deposited in the second station, e.g. a press, the press operation, i.e. lowering of the upper die, may start before the bar has left the work space in between the upper and the lower die. To enable this and to optimize the operating sequence of the press line or the multiple-die press, the path of the empty or loaded bar may be customized by accordingly controlling the pivoting and the lateral motion of the bar. The motions of bars assigned to different stations are independently controllable allowing for further optimization, above all in press lines where the press stations itself may be operated asynchronously.

Preferably, the method comprises the further step of rotatably moving the grippers for at least compensating a change of orientation of the work piece due to the pivoting of the lateral beam. The rotary motion of the grippers is not limited to compensating the change of orientation but the orientation of the work piece may be changed as desired during the transport from a first to a second station, e.g. in order to adapt the orientation to the configuration of the lower die of the second station.

In case the second station is another conveyor for further transporting the work piece, comprising second grippers, the method may include the further step of rotatably moving the grippers of both conveyors such that the work piece held by the grippers of the first conveyor is positioned in a hand-over position, where it may be directly transferred to the second grippers of the other conveyor. Thereby, the work piece is flipped. Flipping the work piece before transporting it to the next press station is frequently required, namely in the case of double-action presses. Employing the inventive method a dedicated intermediate station is spared.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

DETAILED DESCRIPTION OF THE INVENTION

Figure 1:
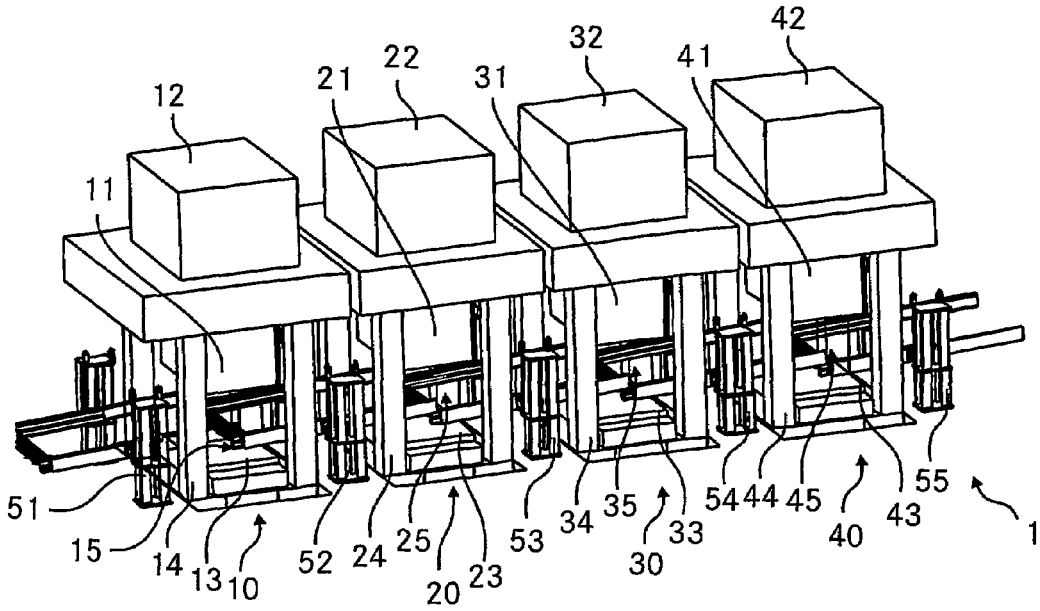
FIG. 1 A press line provided with a conveyor system according to the invention.

FIG. 1 shows a press line provided with a conveyor system according to the invention. The press line 1 includes four press stations 10, 20, 30, 40 that are consecutively arranged in a row. The distance between the centers of adjacent press stations amounts to about 5-6 m. Each of the press stations 10 . . . 40 features an upper die 11, 21, 31, 41 and a corresponding lower die 13, 23, 33, 43. The upper dies 11 . . . 41 are individually vertically movable by respective drives and gears arranged in housings 12, 22, 32, 42 arranged on top of the press stations 10 . . . 40. These mechanisms for moving the upper dies 11 . . . 41 are as such known in the field of press technology and are not shown in detail. The work pieces are formed in between the upper dies 11 . . . 41 and the lower dies 13 . . . 43. The upper dies 11 . . . 41 are mounted on press stands 14, 24, 34, 44, each of them comprising four posts arranged around the work spaces 15, 25, 35, 45 in between the dies 11 . . . 41, 13 . . . 43. The posts of the press stands 14 . . . 44 as well as the lower dies 13 . . . 43 may be individually supported, on individual press beds for each press or on a common press bed for the entire press line 1.

In between two consecutive press stations 10 . . . 40 conveyors 52, 53, 54 are arranged. Further conveyors 51, 55 are arranged before the first press station 10 and after the last press station 40. The first conveyor 51 is arranged in front of the first press station 10 for feeding the press line 1 by raw work pieces from a feeding station (not displayed). The second conveyor 52 is arranged in between the press stands 14, 24 of the first press station 10 and the second press station 20, the third conveyor 53 is arranged in between the press stands 24, 34 of the second press station 20 and the third press station 30, and the fourth conveyor 54 is arranged in between the press stands 34, 44 of the third press station 30 and the fourth press station 40. The last fifth conveyor 55 is arranged after the last press station 40 for removing the formed work piece from the press line 1 and feeding it to a final station, such as a final delivery stack or a conveyor, carrying away the formed work pieces. Each of the conveyors 51 . . . 55 is individually supported. In the displayed situation, all of the conveyors 51 . . . 55 are in the leftmost position, ready for accepting a work piece from the feeding station, respectively the press stations 10, 20, 30, 40 on their left sides.

Figure 2:
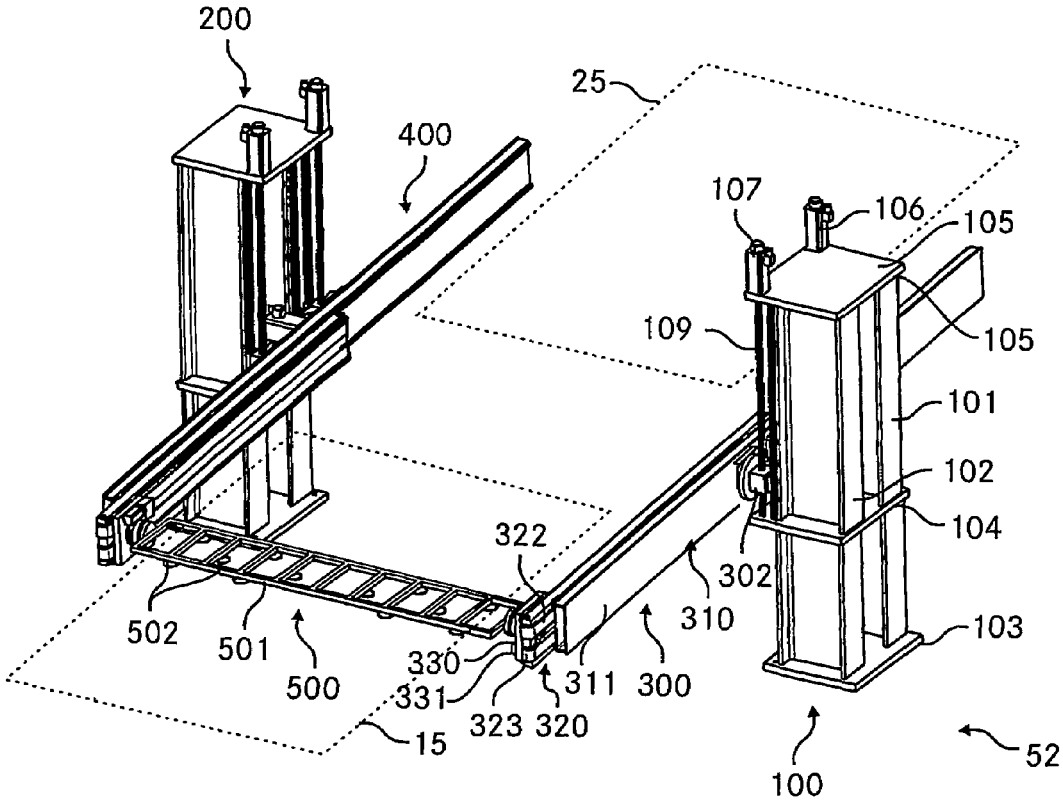
FIG. 2 a perspective view of a conveyor according to the invention.

FIG. 2 is a perspective view of a conveyor according to the invention. The conveyor 52 is built up by a first support assembly 100 arranged on one side of the press line, a second support assembly 200 arranged on the other side, across the press line, a first lateral beam 300 supported by the first support assembly 100 and a second lateral beam 400 supported by the second support assembly 200. A cross-bar 500 is attached to both the lateral beams 200, 400 and extends across the press line, perpendicular to the transport direction that coincides with the axis of the press line. The conveyor 52 is dimensioned such that only its cross-bar 500 penetrates the work spaces 15, 25 of the presses. The support assemblies 100, 200 as well as the lateral beams 300, 400 are arranged laterally of the work spaces 15, 25. The range of the conveyor 52, i.e. the area where work pieces may be picked up or deposited, extends from the center of the first work space 15 to the center of the second work space 25. Accordingly, the range of the adjacent conveyor extends from the center of the second work space 25 to the center of the work space of the adjacent station. That way, each work piece arranged in one of the stations may be reached by the two adjacent conveyors.

Figure 3:
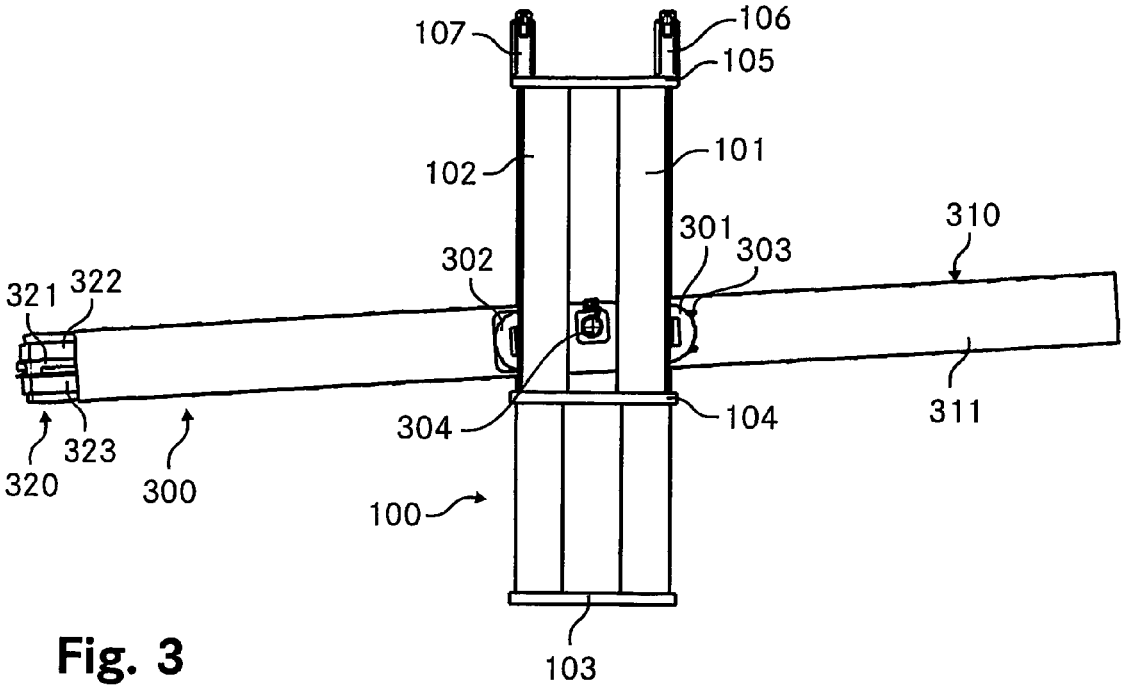
FIG. 3 a stand-up view of the conveyor from the exterior side of a press.
Figure 4:
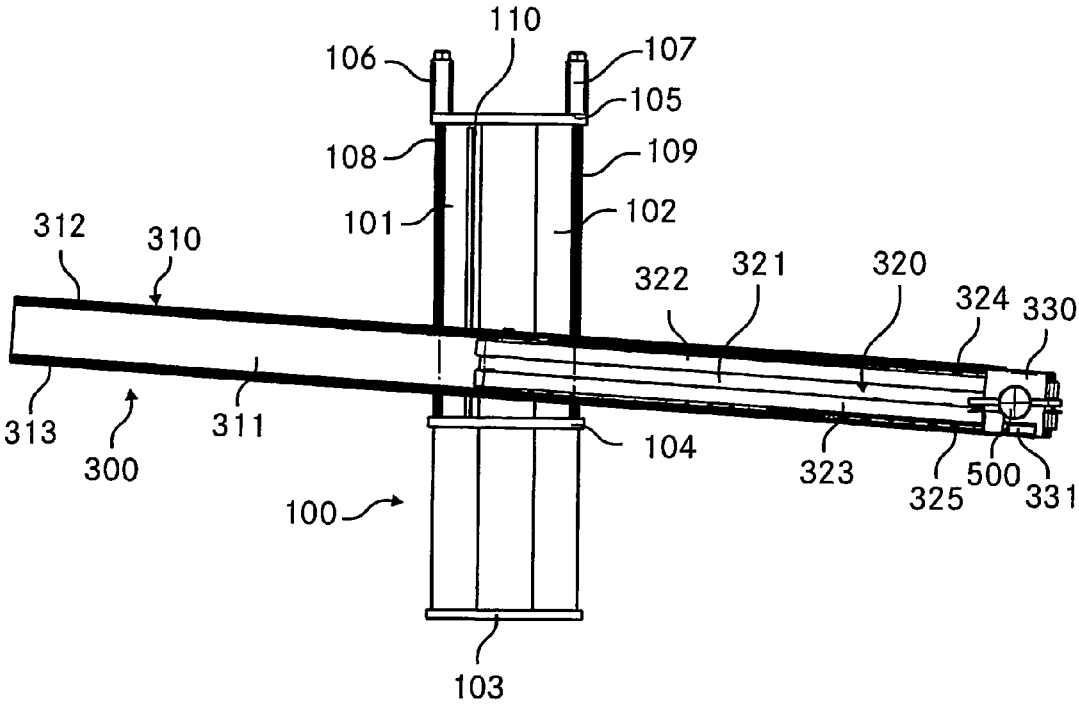
FIG. 4 a stand-up view of the conveyor from the interior side of the press.
Figure 5:
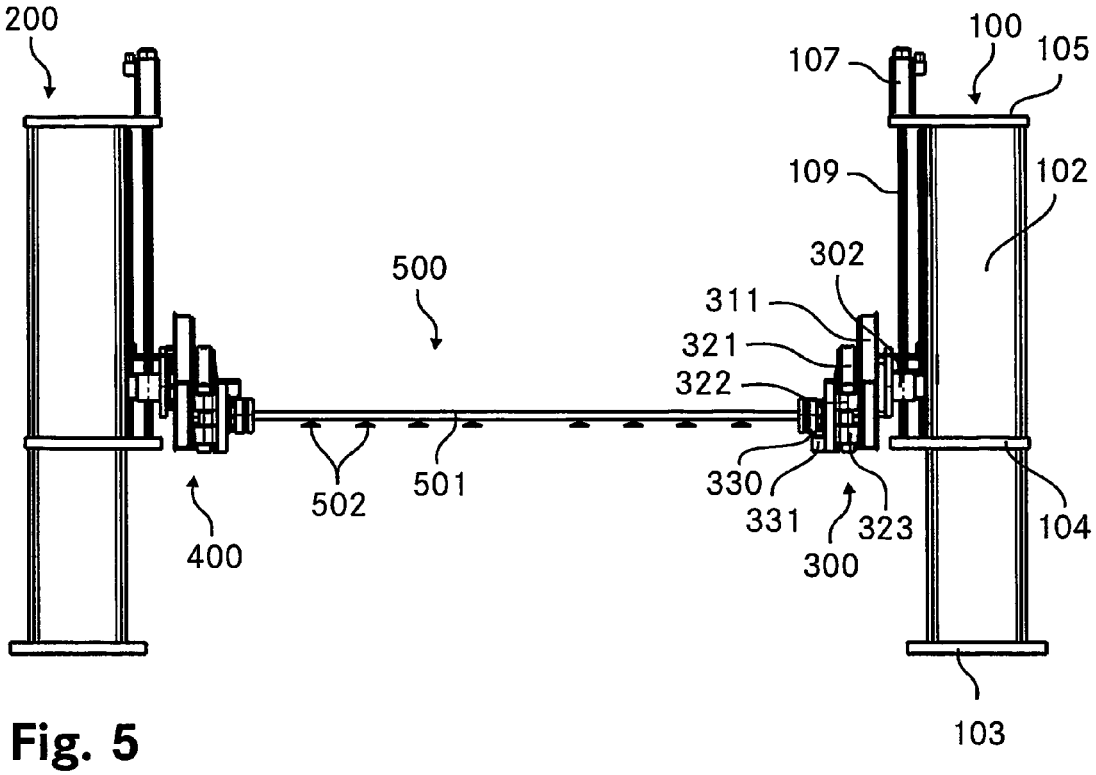
FIG. 5 a stand-up view of the conveyor along the axis of the press.
Figure 6:
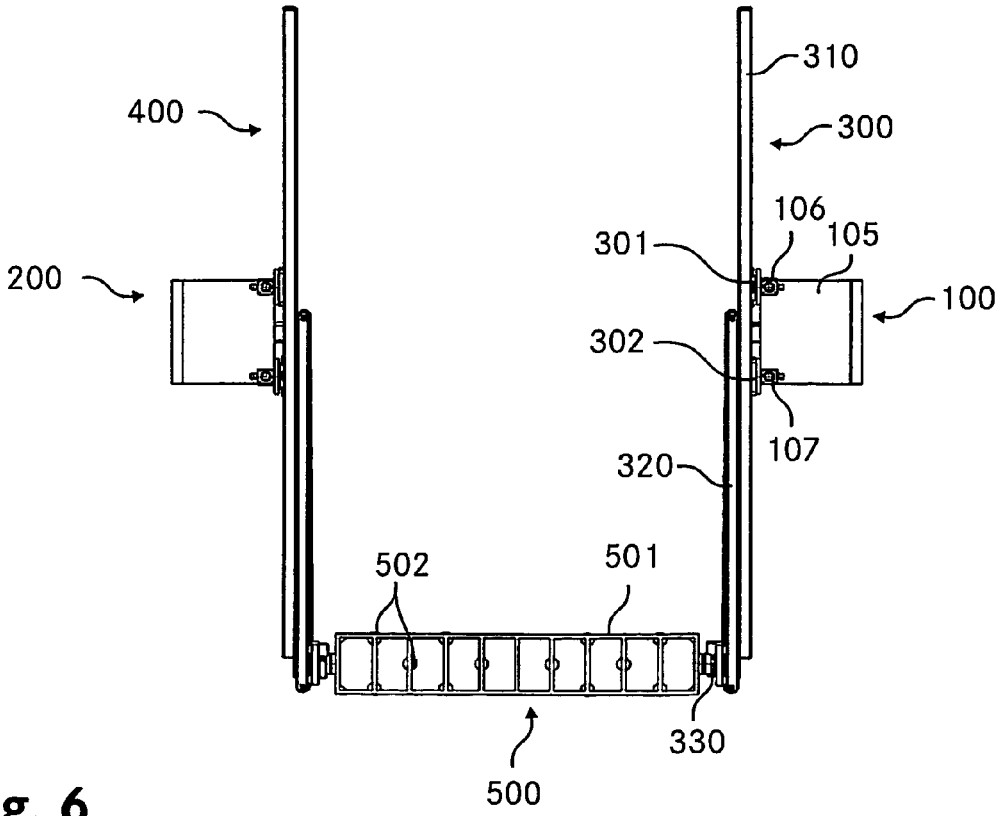
FIG. 6 a top view of the conveyor.

FIGS. 3-6 are different further views of the conveyor: The FIGS. 3-5 are stand-up views from the exterior and the interior side of a press and along the axis of the press, respectively; the FIG. 6 is a top-view of the conveyor. The support assembly 100 comprises two parallel vertical posts 101, 102 fixed in a distance by three horizontal plates: a base plate 103, an intermediate plate 104 and a top plate 105. The vertical posts 101, 102 have an I-shaped profile (see FIG. 2), its main extension being perpendicular to the axis of the press. The base plate 103 serves as a platform, thereby improving the stability of the support assembly 100. The top plate 105 carries two drives 106, 107, each of them coupled to one end of a vertical spindle 108, 109, arranged on the inner side of the support assembly 100. The other ends of the spindles 108, 109 are borne by bearings fixed to the intermediate plate 104. Furthermore, one of the vertical posts 102 carries a vertical guidance 110, extending parallel to the respective spindle 109, on the same inner side of the vertical post 102.

Attached to the inner side of the support assembly 100 is the lateral beam 300. For that purpose, the lateral beam 300 comprises two couplings 301, 302 arranged along the longitudinal extension of the lateral beam 300, symmetrically and close to its center. Each of the couplings 301, 302 cooperates with one of the spindles 108, 109, constituting a ball screw assembly. To this end, the couplings 301 comprise a vertical inner thread, interacting with the outer thread of the vertical spindles 108, 109 by means of a ball bearing formed in between the threads. The vertical inner thread is rotatably fixed with respect to its main (vertical) axis but rotatable around a horizontal axis with respect to the lateral beam 300.

By rotating the spindles 108, 109 in one or the other direction, the couplings 301, 302 are lifted or lowered, respectively. Therefore, by independently operating the spindles 108, 109 the incline of the lateral beam 300 may be set; by simultaneously operating both spindles 108, 109 to have the same rotational speed and the same sense of rotation the lateral beam 300 is lifted or lowered without changing its incline. Both kinds of movements, i.e. pivoting and lifting or lowering, may be superposed by accordingly choosing the rotational movement of the spindles 108,109.

As the incline of the lateral beam 300 is increased, at the same time the distance of the couplings 301, 302 has to be adjusted due to an increased distance of the support points on the spindles 108, 109 with respect to the lateral beam 300. For this purpose, one of the couplings 301 comprises a compensating mechanism 303, which is constituted by two rails parallel to the longitudinal extension of the lateral beam 300 on which the coupling 301 is slidably movable. The other coupling 302 is fixed to the lateral beam 300.

The lateral beam 300 comprises a base part 310, a telescopic drive mechanism 320 and a arriage 330 to which one end of the cross-bar 500 is attached (cf. FIG. 2). A base part 310 is constituted by a hollow section 311 attached to the couplings 301, 302. Two parallel rails 312, 313 are arranged on the inner face of the hollow section 311, extending along the longitudinal extension of the base part 310.

Telescopic drive mechanism 320 is arranged on the inside of the base part 310 and guided on these rails 312, 313. The drive mechanism 320 comprises an intermediate carriage 321 having rollers at both ends over which two belts 322, 323 are guided around the intermediate carriage 321, along its longitudinal extension. The main extension of the intermediate carriage 321 is slightly longer than half the length of the base part 310 of the lateral beam 300. On its inner face, the intermediate carriage 321 comprises a pair of parallel rails 324, 325 for slidably guiding the carriage 330.

On one hand, the belts 322, 323 are fixed to the carriage 330, on the other hand, the belts are fixed to the central portion of the base part 310. As soon as the intermediate carriage 321 is driven along the base part 310 with a given velocity, the carriage 330 is moved in the same direction, having the same velocity relative to the intermediate carriage 321, because of the relative movement of the belts 322, 323 with respect to the intermediate carriage 321. Due to the superposition of the movements the resulting velocity of the carriage 330 with respect to the base portion 310 is about twice that of the intermediate carriage 321.

FIGS. 2-6 show the carriage 330 in its leftmost position. The intermediate carriage 321 together with the carriage 330 are salient with respect to the base part 310 of the longitudinal beam 300. The length of the lateral beam 300 corresponds to the distance of adjacent press stations, i.e. 5-6 m, reduced by the excess length of the telescopic drive mechanism 320. This allows for positioning adjacent conveyors in a press line or multipledie press such that both conveyors may reach the same intermediate position where the work piece is to be deposited or to be picked up, without interference between the lateral beams of the conveyors. Namely, the protruding portion of the intermediate carriage 321 penetrates the interspace between two adjacent lateral beams exclusively during the pickup or deposition of a work piece. Otherwise, the base part 310 leaves enough room for pivoting the lateral beams and for positioning the cross-bar of the adjacent conveyor in the interspace between the beams.

A drive 304 is attached to the back side of the central portion of the lateral beam 300. It penetrates the interspace between the vertical posts 101, 102 which leaves ample clearance such that the drive 304 does neither interfere with the pivoting of the lateral beam 300 nor with its lifting or lowering. The drive cooperates with a rack attached to the intermediate carriage 321, such that the intermediate carriage 321 may be moved relative to the base part 310 of the lateral beam 300.

On the carriage 330 a drive 331 for rotating the cross-bar 500 is arranged. This drive 331 may be small if it is coupled to the cross-bar 500 by a gear reduction. The cross-bar 500 is constituted by a latticelike frame 501 carrying a plurality of suction tools 502 for gripping the work pieces to be transported. On one hand, rotating the cross-bar 500 serves to compensate the change of orientation of the cross-bar 500 due to the pivoting of the lateral beam 300. On the other hand, the orientation of the cross-bar 500 may be optimized for picking up a work piece, and the orientation of the transported work piece may be adapted to the destination of the work piece, e.g. to the configuration of the die of the destination press or of a delivery stack. The cross-bar 500 may be automatically decoupled from the carriage 330 for replacement by another cross-bar, that has e.g. another kind of grippers. The replacement of grippers preferably takes place on a moving bolster or on a separate carriage.

The power for the drive 331 for rotating the cross-bar 500 as well as compressed air needed for the suction tools 502 are delivered by means of a drag chain comprising electric cables and an air line, arranged on top of the base part 310 of the lateral beam 300. For clarity, the drag chain is not displayed in the figures.

Figure 7:
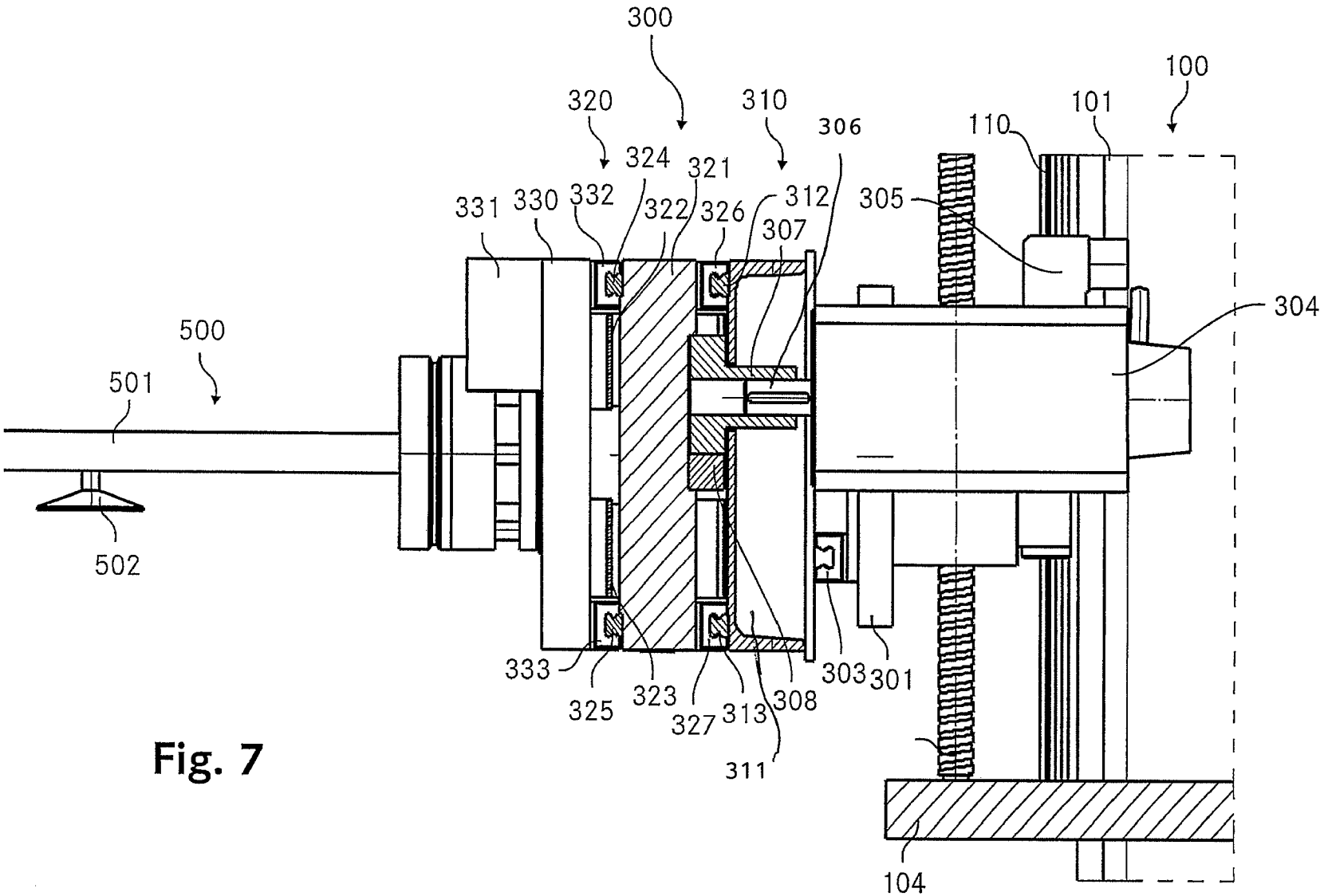
FIG. 7 a detailed view of the telescopic drive mechanism of the conveyor.

FIG. 7 shows a detailed view of the telescopic drive mechanism of the conveyor. The telescopic drive mechanism 320 is a part of the lateral beam 300 which is attached by means of a coupling 301 to the spindle 108 borne at its lower end on the intermediate plate 104 of the support assembly 100. The coupling 301 comprises a rotary plate with a pivot bearing for adjusting the orientation of the coupling 301 attached to the lateral beam 300 relative to the vertical thread coupled to the spindle 108. The coupling 301 further comprises a compensating mechanism 303 constituted by a horizontal rail attached to the base part 310 of the lateral beam 300 and a corresponding guidance attached to the coupling 301. The compensating mechanism 303 allows for compensating the varying distance between the support points of the couplings on the spindles.

As well, the lateral beam 300 comprises a support 305 that cooperates with the vertical guidance 110 fixed to one of the vertical posts 101. The support 305 carries part of the tilting torque and support forces arising between the lateral beam 300 and the support assembly 100 and thereby releases the spindles.

The drive 304 is attached to the back side of the hollow section 311 of the base part 310 of the lateral beam 300. A drive shaft 306 protrudes from the front face of the drive 304, its axis being horizontal and perpendicular to the main extension of the lateral beam 300. The drive shaft 306 penetrates the hollow section 311 through an opening in the rear surface. A pinion 307 arranged in front of the hollow section 311 is attached to the front end of the drive shaft 306, through another opening in the front surface of the hollow section 311. The pinion 307 cooperates with a rack 308 attached to and extending along the intermediate carriage 321. Therefore, by operating the drive 304 the intermediate carriage 321 is driven along the main extension of the base part 310 of the lateral beam 300.

The intermediate carriage 321 is slidably mounted to the base part 310 by guidances 326, 327 attached to the intermediate carriage 321 cooperating with the rails 312, 313 of the base part 310. The carriage 330 holding the cross-bar 500 is slidably mounted to the intermediate carriage 321 by guidances 332, 333 attached to the carriage 330 cooperating with the rails 324, 325 of the intermediate carriage 321.

The belts 322, 323 guided around the intermediate carriage 321 are fixed to the central portion of the base part 310, near to where the drive 304 is arranged. As well, the belts 322, 323 are fixed to the carriage 330. The belts 322, 323 are freely movable with respect to the intermediate carriage 321, guided by the rollers arranged at both its ends.

Figure 8A:
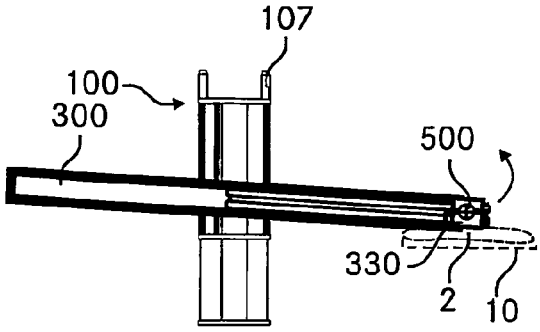
FIG. 8A-F a schematic illustration of the inventive process.

FIGS. 8A-F are a schematic illustration of the inventive process. FIG. 8A shows the cross-bar 500 in its rightmost position; the lateral beam 300 is inclined such that the cross-bar 500 is lowered relative to the center of the lateral beam 300. Typically, the maximum lift range needed is about 30 cm or less, which means that the maximum inclination angle relative to a horizontal plane is about 6° or less. In the inclined position, picking up of a work piece 2 positioned in the first station 10 is accomplished by providing a negative pressure to the suction tools of the cross-bar 500. As soon as the work piece 2 is picked up, the right spindle 107 of the support assembly 100 is operated to pivot the lateral beam 300, such that it reaches its horizontal position. Thereby, the work piece 2 is lifted up from the first station 10. During the pivoting motion, as soon as the work piece 2 is released from the first station 10, the horizontal movement of the carriage 330 holding the cross-bar 500 starts. This allows for rapidly removing the cross-bar 500 from the work space in between the upper and the lower die and therefore for maximizing the efficiency of the process performed by the press line. During the lifting process, the cross-bar 500 is rotated in order to compensate the relative orientation of the cross-bar 500 with respect to the carriage 330. Therefore, the orientation of the work piece 2 remains constant.

Figure 8B:
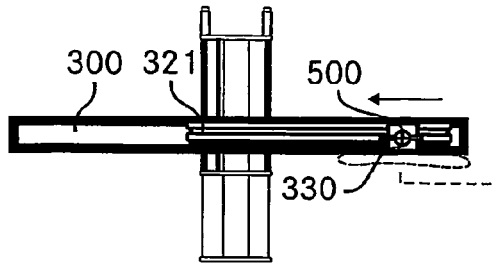
Figure 8C:
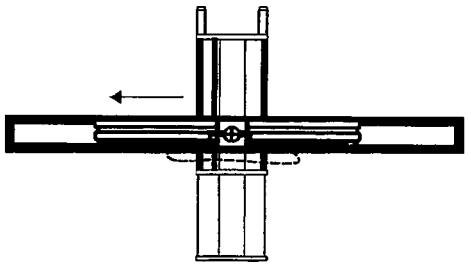

In the situation as shown in FIG. 8B, immediately after the lateral beam 300 has reached its horizontal position, because of the simultaneous pivoting of the lateral beam 300 and moving of the carriage 330, the cross-bar 500 has already moved towards the center of the lateral beam 300. In the following, the movement of the carriage 330 continues. Note that the carriage 330 moves at double the speed of the intermediate carriage 321, due to the telescopic arrangement of the carriages. FIG. 8C shows the center position of the conveyor.

Figure 8D:
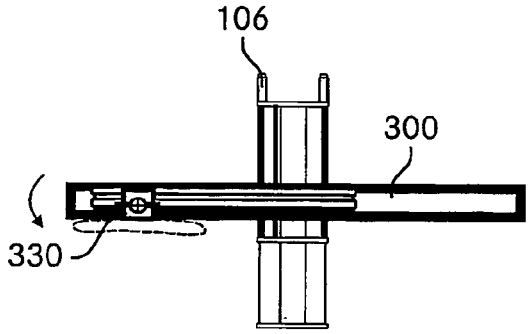
Figure 8E:
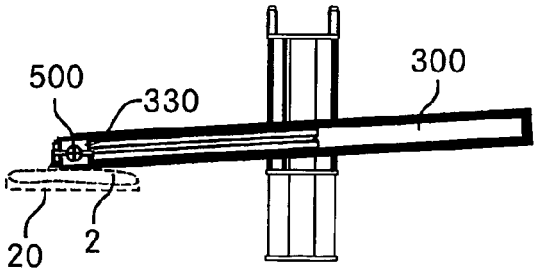

FIG. 8D shows the situation immediately before the pivoting movement of the lateral beam 300 starts. The carriage 330 with the cross-bar 500 has not yet reached its leftmost position and continues to be moved to the left during the pivoting motion of the lateral beam 300, effected by rotating the left spindle 106. FIG. 8E shows the situation in which the leftmost position is reached and in which the lateral beam 300 is inclined such that the work piece 2 may be disengaged from the cross-bar 500 and deposited in the second station 20. Again, during the lowering process, the cross-bar 500 is rotated in order to compensate the change of relative orientation of the cross-bar 500 with respect to the carriage 330, such that the orientation of the work piece 2 remains constant.

Figure 8F:
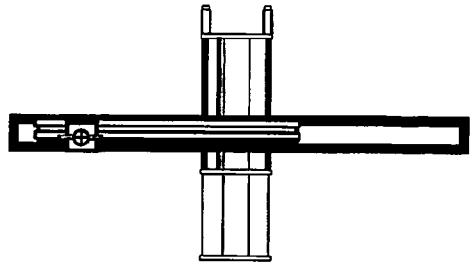

Following disengagement of the work piece 2, the empty cross-bar 500 will be lifted by pivoting the lateral beam 300 and as soon as it is possible the horizontal movement of the cross-bar 500 back towards the center of the lateral beam 300 will start, such that the situation displayed in FIG. 8F is reached. The following cycle of the process for again transporting a work piece 2 from the first station 10 to the second station 20 will follow as soon as the work piece 2 is ready for transportation.

Note, that the lateral beam 300 itself was neither lowered nor lifted as a whole during the described process. The lowering and lifting of the cross-bar 500 has been exclusively effected by the pivoting motion of the lateral beam 300. The lift range may be further increased without having to lift the entire lateral beam 300: This is achieved by pivoting the lateral beam 300 beyond its horizontal position during the lifting process and—as soon as the work piece has been removed from the first station—by pivoting the lateral beam 300 back into its horizontal position.

However, lifting the lateral beam 300 may be required if maintenance work is to be carried out or if the dies are changed. Furthermore, depending on the geometry of the press line and the conveyor, the movement of the cross-bar 500 may be more flexibly controlled if the pivoting movement is supplemented by vertical movements of the entire lateral beam 300. Note, that each conveyor (in the displayed embodiment comprising two support assemblies, two lateral beams and the cross bar) of a press line may be operated independently. This allows for further optimizing the process flow of the press line.

Figure 9:
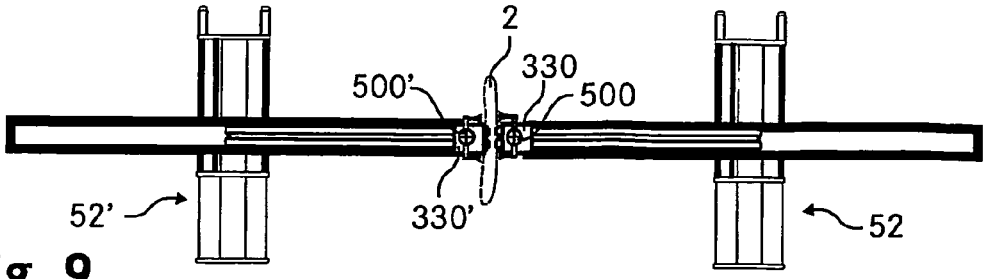
FIG. 9 a schematic illustration of the hand-over of a work piece among two adjacent conveyors in order to flip the work piece.

FIG. 9 is a schematic illustration of the hand-over of a work piece among two adjacent conveyors 52, 52', in order to flip the work piece. For performing the hand-over the cross-bar 500 holding the work piece is rotated about 90°, such that the work piece 2 is held upright. Following this, the carriages 330, 330' of the two adjacent conveyors 52, 52' are moved near to its neighboring outermost positions, depending on the width of the work piece 2. At the same time, the cross-bar 500' of the second conveyor 52' is rotated such that its grippers face the grippers of the other cross-bar 500 of the first conveyor 52. It is in this position that the hand-over is enabled: For a short moment, the work piece 2 is held from both sides, until the first conveyor 52 disengages from the work piece 2 and removes the cross-bar 500. By rotating the cross bar 500' of the second conveyor 52', the work piece 2 is again oriented such that it may be introduced into e.g. a press station. However, due to the hand-over as displayed in FIG. 9, the orientation of the work piece 2 has been flipped.

Figure 10:
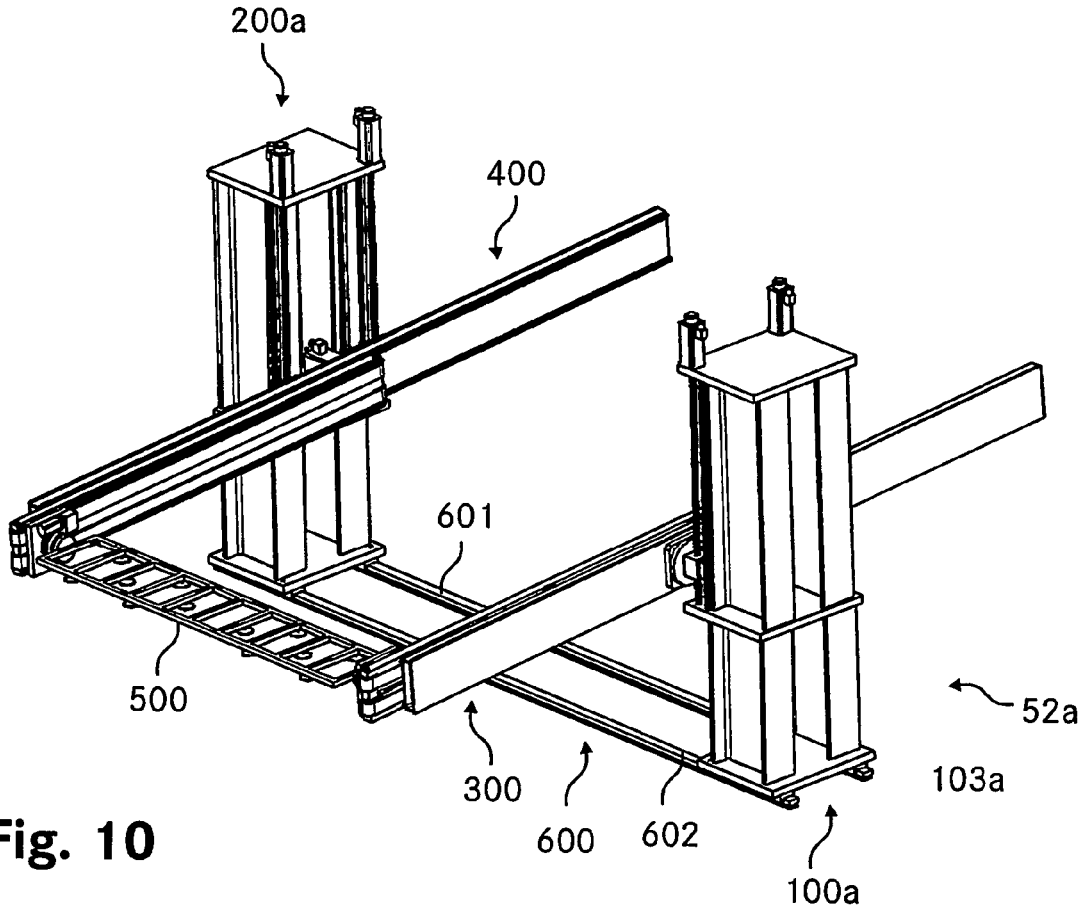
FIG. 10 a perspective view of a conveyor according to the invention, having relocatable support assemblies.

FIG. 10 is a perspective view of a conveyor according to the invention, having relocatable support assemblies. The conveyor 52*a* essentially corresponds to the conveyor 52 displayed in FIGS. 2-7. However, the support assemblies 100*a*, 200*a* of the conveyor 52*a* for supporting the lateral beams 300, 400 are modified such that they are relocatable in a direction transverse to the transport direction. For this purpose, the support assemblies 100*a*, 200*a* are supported on two parallel rails 601, 602 extending across the press, running underneath the lower die of the press. The rails 601, 602 extend end-to-end from one support assembly 100*a* to the other support assembly 200*a*, constituting a track 600 along which the support assemblies 100*a*, 200*a* may be relocated.

Both support assemblies 100*a*, 200*a* comprise reels or runners on the bottom side of their base plates 103*a* cooperating with the rails 601, 602. Furthermore, they comprise fixing means for fixing the location of the support assemblies 100*a*, 200*a* on the rails 601, 602. If the conveyor 52*a* is used for transporting work pieces in a press having a pair of dies of a smaller width than the maximum length of the cross-bar 500, the long cross-bar 500 is removed, the fixing means of the support assemblies 100*a*, 200*a* are disengaged and the support assemblies 100*a*, 200*a* are relocated such that a shorter cross-bar may be used whose length is adapted to the width of the dies. Finally, the relocated support assemblies 100*a*, 200*a* are again fixed to the rails 601,602 at their new positions.

Although the arrangement for relocating the support assemblies is shown with a conveyor according to the invention, having pivotable lateral beams, the area of application of this arrangement is not limited to such conveyors. It extends as well to other conveyor systems having an interchangeable cross-bar extending across the press which is supported on both its sides by support assemblies, e.g. conveyor systems that are already known as such, having e.g. carriages supported on horizontal rails, pivotable arms or guide-rod mechanisms for holding the cross-bar.

In certain cases it may suffice if only one of the support assemblies is relocatable in a direction perpendicular to the transport direction, i.e. closer or farther away from the press. The rails may be divided instead of continuous. Instead of rails and reels or runners other known bearings allowing for a linear motion may be employed. For even simpler handling of the arrangement, the two support assemblies and/or the fixing means may be coupled to each other, e.g. by a chain drive, such that relocating of one of the assemblies leads to an according symmetric relocation of the other assembly and/or fixing of both assemblies happens simultaneously. The adjustment of the distance between the support assemblies may be performed manually or automatically, by correspondingly controlling a drive for moving the support assemblies along the transverse track.

Figure 11A:
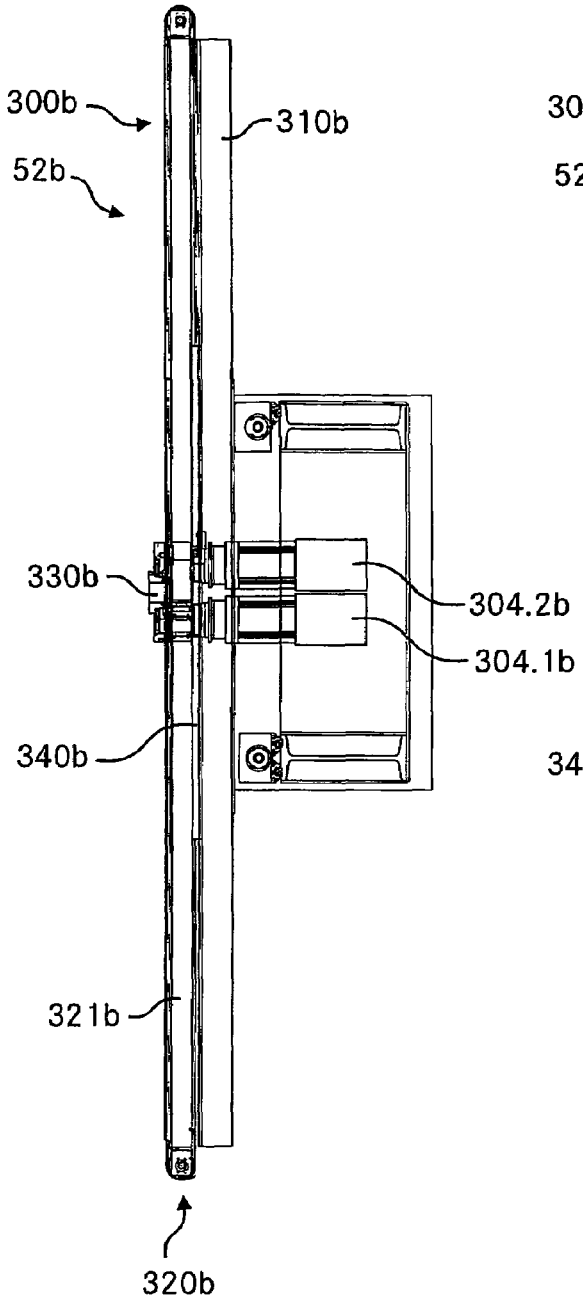
FIG. 11A, B top views of two positions of a further embodiment of a conveyor according to the invention, having a telescopic drive mechanism featuring an additional linear guideway.

FIGS. 11A, B show top views of two positions of a further embodiment of a conveyor according to the invention, having a telescopic drive mechanism featuring an additional linear guideway. Generally, the construction of the conveyor corresponds to that of the conveyor discussed in connection with FIGS. 1-7. However, this further embodiment of the conveyor 52*b* features a lateral beam 300*b* having a base part 310*b* of a reduced length, compared to the embodiment discussed above. The length of the base part 310*b* just about corresponds to the length of the intermediate carriage 321*b*. In order to allow for a reliable support of the intermediate carriage 321*b* on the base part 310*b*, a linear guideway 340*b* is provided in between the base part 310*b* and the intermediate carriage 321*b*. The linear guideway 340*b* is slidably movable with respect to both its neighboring parts. Its length corresponds to about half the length of the intermediate carriage 321*b*.

Together with the linear guideway 340*b* the telescopic drive mechanism 320*b*, which is essentially constructed as described in connection with FIGS. 5-7, constitutes a three-stage telescopic drive, i.e. the relative velocity of the carriage 330*b*, to which a cross-bar may be coupled, with respect to the base part 310*b* (which does not move horizontally along the press), is apportioned to a first velocity of the linear guideway 340*b* with respect to the base part 310*b*, a second velocity of the intermediate carriage 321*b* with respect to the linear guideway 340*b* and a third velocity of the carriage 330*b* with respect to the intermediate carriage 321*b*. The telescopic drive mechanism 320*b* is actuated in the same way as in the embodiment discussed above, i.e. employing a rack-and-pinion drive, with the exception that two drives 304.1*b* and 304.2*b* are provided for offering better dynamics.

FIG. 11A depicts the situation where the carriage 330*b* is in its central position. In that state, the intermediate carriage 321*b* and the linear guideway 340*b* are as well in their central positions, i.e. symmetrical with respect to the center of the lateral beam 300*b*. Because of the reduced length of the base part 310*b* the extension of the conveyor 52*b* along the press is reduced (cf. FIG. 8C) which allows for untroubled machining of the work pieces in the adjacent presses.

Figure 11B:
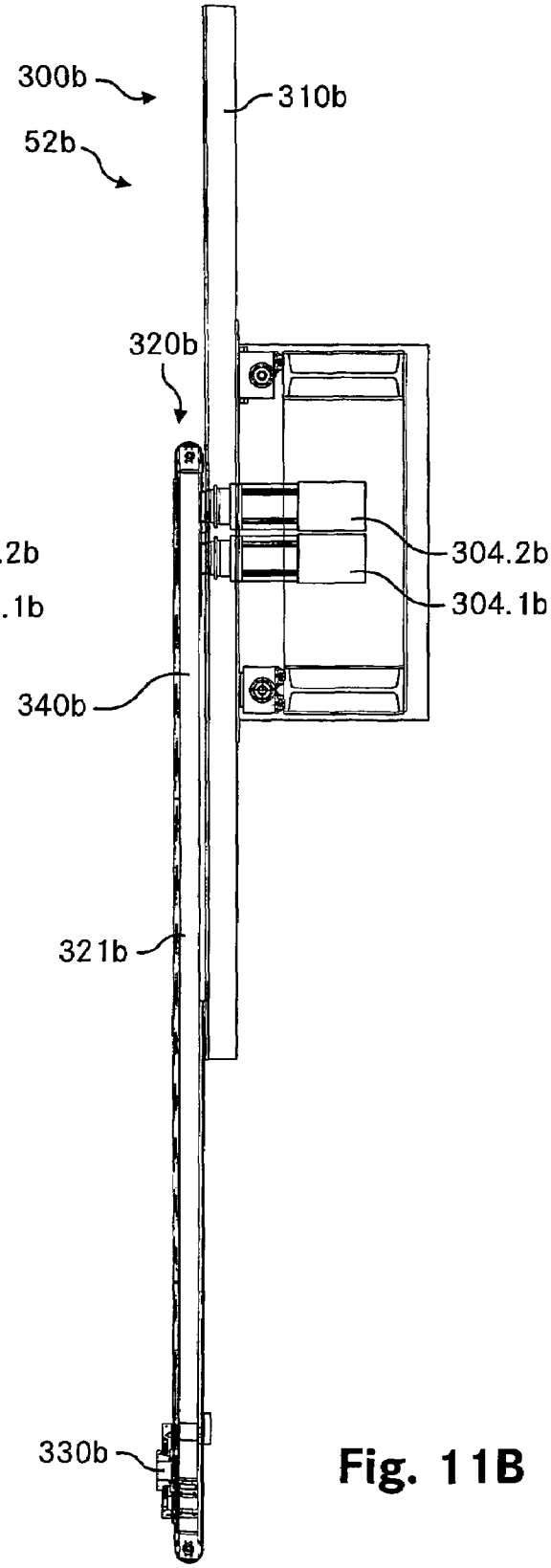

FIG. 11B depicts the outermost position of the carriage 330*b* with respect to the lateral beam 300*b*. Almost half of the intermediate carriage 321*b* longitudinally protrudes over the base part 310*b* of the lateral beam 300*b*. The linear guideway 340*b* has moved towards the respective end of the base part 310*b* and is still supporting the intermediate carriage 321*b* along its entire length, partially including the portion where the two drives 304.1*b*, 304.2*b* cooperate with the intermediate carriage 321*b*. Thereby, a stable support of the intermediate carriage 321*b* is ensured, especially in the region where the drives 304.1*b*, 304.2*b* exert moments and forces on the intermediate carriage 321*b*. The path of the carriage 330*b* is apportioned to relative paths of the linear guideway 340*b*, the intermediate carriage 321*b* and the carriage 330*b* with respect to their neighboring outer element at a ratio of 1:1:2, i.e. the absolute paths of the these elements are at a ratio of 1:2:4.

Figure 12:
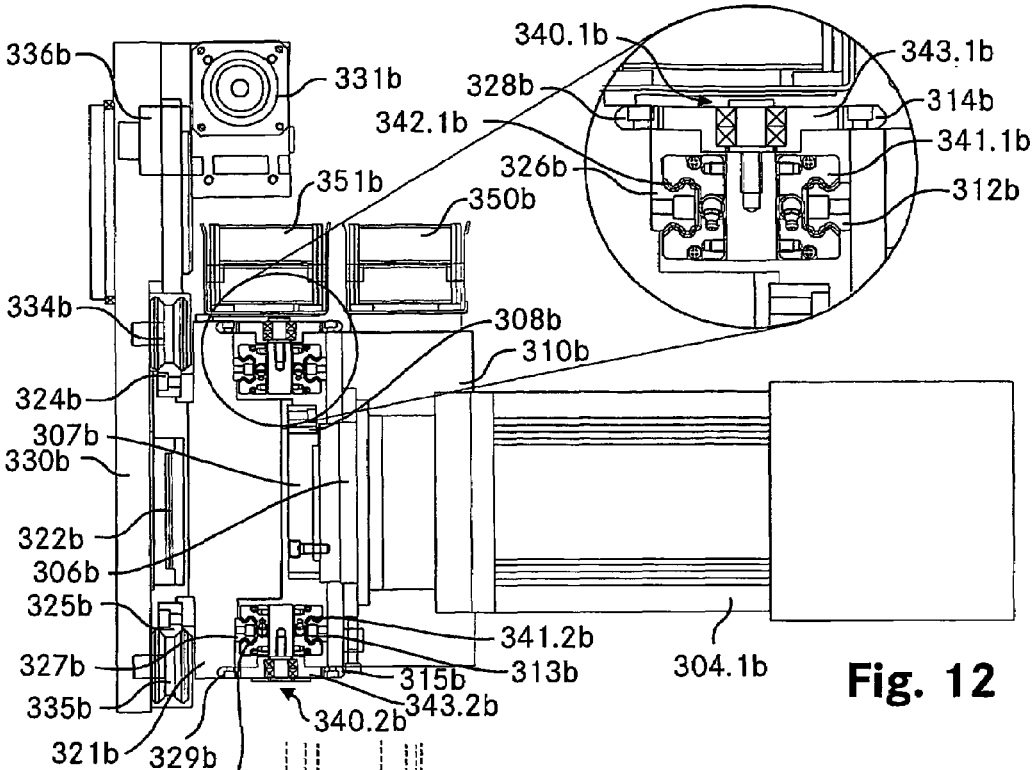
FIG. 12 a detailed view of a first implementation of the additional linear guideway.

FIG. 12 shows a detailed view of a first implementation of the additional linear guideway. Again, the rotary movement of the drive 304.1*b* attached to the back side of the base part 310*b* is transmitted to the intermediate carriage 321*b* by means of a pinion 307*b* attached to a drive shaft 306*b* of the drive 304.1*b* cooperating with a rack 308*b* fixed to and extending along the intermediate carriage 321*b*. Two linear guideways 340.1*b*, 340.2*b* are disposed one above the other, in between the base part 310*b* and the intermediate carriage 321*b*. Each of the guideways 340.1*b*, 340.2*b* cooperates with two parallel rails 312*b*, 326*b*; 313*b*, 327*b* attached to the base part 310*b* and the intermediate carriage 321*b*, respectively. For this purpose, the guideways 340.1*b*, 340.2*b* feature monorail bearings 341.1*b*, 342.1*b*; 341.2*b*, 342.2*b* that are known as such in the state of the art. For ensuring synchronous operation of the guideways 340.1*b*, 340.2*b*, i.e. to make sure that the position of the guideways 340.1*b*, 340.2*b* is always uniquely defined by the positions of the neighboring elements, the guideways 340.1*b*, 340.2*b* each comprise a cogwheel 343.1*b*, 343.2*b* that is freely rotatable around a vertical axis, i.e. an axis that is perpendicular to the plane defined by the parallel rails 312*b*, 326*b*; 313*b*, 327*b*. Each of the cogwheels 343.1*b*, 343.2*b* cooperates with two opposed parallel cograils 314*b*, 328*b*; 315*b*, 329*b* that are parallel to the rails

312*b*, 326*b*; 313*b*, 327*b* and are fixed to the base part 310*b* and the intermediate carriage 321*b*, respectively.

The carriage 330*b* for holding a cross-bar (or other kind of gripping tool) is slidably mounted on the intermediate carriage 321*b* by means of reels 334*b*, 335*b* rotatably mounted to the carriage 330*b*, running on longitudinal rails 324*b*, 325*b* attached to the intermediate carriage 321*b*. Compared to the embodiments described above, the carriage 330*b* is constructed such that its width (i.e. its extension in a direction across the press) is reduced. To achieve this, the carriage 330*b* extends above the intermediate carriage 321*b*, such that the drive 331*b* for actuating rotary movement of the gripping tool may be attached above the intermediate carriage 321*b*, to the back side of the carriage 330*b*. The movement of the drive 331*b* is transmitted to the front side of the carriage 330*b* by a corresponding transmission 336*b*. The reduced-width carriage 321*b* may as well be employed together with the first embodiment of the invention, discussed in connection with FIGS. 1-7.

Again, a belt 322*b* guided around the intermediate carriage 321*b* is fixed to the central portion of the base part 310*b*. As well, the belt 322*b* is fixed to the carriage 330*b*. Again, the belt 322*b* is freely movable with respect to the intermediate carriage 321*b*, guided by rollers arranged at both its ends.

FIG. 12 as well shows two trailing cable installations 350*b*, 351*b* comprising longitudinal conduits attached to the base part 310*b* and the intermediate carriage 321*b*, respectively. A first cable running in the conduit attached to the base part 310*b* is connected on the intermediate carriage 321*b* to a second cable running in the conduit attached to the intermediate carriage 321*b*, whereby the second cable is connected to the consumers on or attached to the carriage 330*b* (i.e. the drive 331*b* for rotating the grippers, suction tools etc.) Compared to a single cable, the two cables experience lower forces such that their lifetime is increased. The first embodiment discussed above may be as well equipped with two trailing cable installations as described in connection with the present embodiment.

Figure 13:
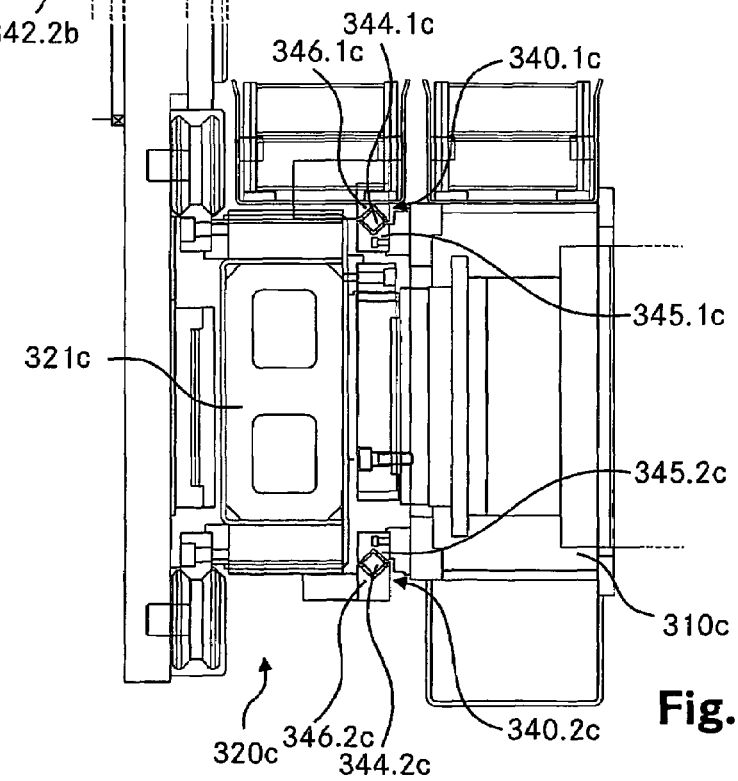
FIG. 13 a detailed view of a second implementation of the additional linear guideway.

FIG. 13 shows a detailed view of a second implementation of the additional linear guideway. In most of the aspects, its construction corresponds to those of the implementation discussed in connection with FIG. 12. That is why in the following we concentrate on the differences. In order to reduce the overall width of the lateral beam the linear guideways 340.1*c*, 340.2*c* are of another type, featuring positive control cages 344.1*c*, 344.2*c*. Such guideways are commercially available (e.g. INA guideways MVZ of INA-Schaeffler KG or Schneeberger Formula-S guideways). They comprise two parallel rails 345.1*c*, 346.1*c*; 345.2*c*, 346.2*c* having V-shaped profiles enclosing the central cage 344.1*c*, 344.2*c*, which is slidably movable with respect to both the rails 345.1*c*, 346.1*c*; 345.2*c*, 346.2*c*. Positive control is effected by cogwheels that are rotatably mounted to the cage 344.1*c*, 344.2*c* and that cooperate with cograils fixed to the two rails 345.1*c*, 346.1*c*; 345.2*c*, 346.2*c* of the linear guideways 340.1*c*, 340.2*c*. In this implementation, the cage 344.1*c*, 344.2*c* effectively constitutes the first stage of the telescopic drive mechanism 320*c* whereas the rails 345.1*c*, 346.1*c*; 345.2*c*, 346.2*c* of the linear guide-ways 340.1*c*, 340.2*c* are fixed to the neighbouring elements, i. e. the base part 310*c* and the intermediate carriage 321*c*.

The flexibility of the cross-bar conveyor system is enhanced if the cross-bar is attached to the carriages running along the longitudinal bars in such a way that the two carriages may be independently displaced in horizontal and/or vertical directions. Thereby, by independently displacing the carriages as well as positioning the lateral beams the position and orientation of the cross-bar may be adapted to the form and orientation of the work piece to be picked up or to be deposited. Furthermore, a flexible adaptation of the orientation of the work piece during the transfer process from one station to the next one is enabled. For this purpose, couplings between the carriages and the cross-bar are employed that allow for an incline of the cross-bar in a vertical plane as well as in a horizontal plane. This may be achieved e.g. by means of a universal joint. Furthermore, because the distance between the carriages increases in cases where the cross-bar is inclined, a compensating mechanism, e.g. a telescopic mechanism, is arranged at one of the couplings, at both couplings or along the cross-bar for adapting the effective length of the cross-bar to compensate for the varying distance.

For reducing the forces and moments acting on the drives for the spindles, a weight compensation mechanism may be provided that compensates the weight differences of the parts of the lateral beam on both sides of the actual pivoting axis, caused by the pivoting motion of the lateral beam. Basically, this mechanism may comprise a substantially vertical arm that is rotatably and slidably supported on the support assembly of the conveyor, whereby the rotation axis is located straight above the center of the lateral beam (as long as the beam is in a horizontal position). Across the rotation axis, the arm features a massive element. On the opposite end, the arm is fixed to the center of the lateral beam.

As a matter of course, the technical details of the discussed embodiments may be modified without leaving the scope of the invention. First of all, the indicated dimensions are to be understood as exemplary. The inventive conveyor system is as well appropriate for press lines or multiple-die presses having smaller or larger presses and/or smaller and larger distances between adjacent press stations, e.g. distances of 3-9m. The employed maximum inclination angle of the lateral beam and the lift range may be correspondingly adapted. Similarly, the conveyor system is applicable with any number of presses or pairs of dies in a press line or multiple-die press, respectively. The conveyor system may be integrated into a variety of press configurations, e.g. independent of the arrangement of the support for the upper dies or of the press bed. The inventive conveyor system is particularly suited for retrofitting of existing press lines or multiple-die presses but as well for integration into newly built appliances.

Furthermore, the telescopic drive mechanism may include other means of driving the intermediate carriage such as a belt drive or a linear induction motor. The path covered by the intermediate carriage relative to the path covered by the carriage attached to the cross-bar may differ if an according gear unit is provided. In certain instances, in particular if the range of the conveyor is rather short or if the weight of the work pieces is small, a telescopic drive mechanism may be omitted and the cross-bar may be directly driven relative to the lateral beam.

The arrangement of the lateral beam may be modified as well. For example, the intermediate carriage may rest on the base part or the intermediate carriage may hang down from the base part, i.e. the elements of the drive mechanism may be arranged on top of each other. The rails and guidances between the carriages and the base part may be complemented or replaced e.g. by rolls.

If it is the only task of the drive for rotating the cross-bar to compensate the change of orientation of the work piece due to the pivoting of the lateral beam, the construction may be simplified by omitting the drive and providing a mechanical feed for directly compensating the change of orientation, depending on the incline of the lateral beam.

In summary, it is to be noted that the invention creates a conveyor for transporting work pieces in a press that is of a simple construction, allows for a long transport range and for efficient and fast transport of the work pieces.

The invention claimed is:

1. A conveyor for transporting work pieces in a press line or multiple-die press from a first station to a second station adjacent to the first station, comprising at least one lateral beam arranged on a side of the press, essentially extending parallel to a transport direction of the conveyor;

at least one bar having grippers for gripping the work piece to be transported, the at least one bar being attached to the lateral beam such that the bar is movable along a longitudinal extension of the beam; and an assembly for supporting each of the at least one lateral beam;

wherein the assembly comprises a pivoting mechanism for pivoting the lateral beam about a horizontal pivotal axis perpendicular to the transport direction, the pivoting mechanism including two spindles, the two spindles being independently operable to pivot and vertically displace the lateral beam, the grippers are rotatably movable for at least compensating a change of orientation of the work piece due to the pivoting of the lateral beam, and the lateral beam includes two couplings arranged along a longitudinal extension of the at least one lateral beam, whereby each of the couplings cooperates with one of the two spindles.

2. The conveyor according to claim 1, wherein the pivoting mechanism is formed such that the pivotal axis crosses a vertical plane comprising the lateral beam, either above, below or through the lateral beam (300), in particular close to a middle portion of the lateral beam.

3. The conveyor according to claim 1, wherein the at least one lateral beam comprises two lateral beams arranged across the press and in that the bar is a cross-bar extending across the press, attached to the two lateral beams.

4. The conveyor according to claim 3, wherein at least one of the assemblies for supporting one of the two lateral beams is relocatable in a direction transverse to the transport direction, in order to adjust a distance between the two lateral beams.

5. The conveyor according to claim 1, wherein the assembly further comprises a lift mechanism for displacing the lateral beam in a vertical direction.

6. The conveyor according to claim 1, wherein at least one lateral beam comprises a telescopic drive mechanism for moving the bar along a longitudinal direction of the at least one lateral beam.

7. The conveyor according to claim 6, wherein the telescopic drive mechanism includes a support beam attached to the pivoting mechanism, a first carriage slidably mounted to the support beam, and a second carriage slidably mounted to the first carriage.

8. The conveyor according to claim 7, wherein an intermediate linear guideway is arranged between the support beam and the first carriage, whereby the guideway is slidable with respect to the support beam as well as to the first carriage.

9. The conveyor according to claim 1, characterized in that all the drives for (106, 107, 304) moving the bar (500) along the beam (300) as well as for pivoting the beam (300) are stationary in respect of the motion of the bar (500) along the longitudinal extension of the beam (300).

10. The conveyor according to claim 1, wherein the two couplings are arranged symmetrically and close to a center of the lateral beam.

11. A conveyor system for transporting work pieces in a press line or multiple-die press, comprising:

a plurality of conveyors according to claim 1, arranged consecutively.

12. The conveyor system according to claim 11, wherein two consecutive conveyors are arranged such that the work piece is handed over from a first of the conveyors to a second of the conveyors, whereby the work piece is flipped.

13. A method for transporting work pieces in a press line or multiple-die press from a first station to a second station adjacent to the first station, employing a bar attached to a lateral beam arranged on a side of the press, extending parallel to a transport direction, comprising:

positioning the bar above the work piece situated in the first station;

lowering the bar by pivoting the lateral beam about a horizontal pivotal axis perpendicular to the transport direction;

gripping the work piece by grippers attached to the bar;

lifting the bar by pivoting the lateral beam around the pivotal axis;

transporting the work piece to the second station by moving the bar along a longitudinal extension of the beam;

positioning the bar in a hand-over position by pivoting the lateral beam about the pivotal axis; and disengaging the work piece from the grippers.

14. The method according to claim 13, wherein moving the bar along the longitudinal extension of the beam and pivoting of the beam at least partially take place simultaneously.

15. The method according to claim 13, further comprising:

rotatably moving the grippers for at least compensating a change of orientation of the work piece due to the pivoting of the lateral beam.

16. The method according to claim 15, wherein the second station is another conveyor for further transporting the work piece-and having second grippers, the method further comprising:

rotatably moving the grippers such that the work piece held by the grippers is directly transferred to the second grippers of the other conveyor, thereby flipping the work piece.

* * * * *